United States Patent [19]

Roberson

[11] Patent Number: 4,993,119

[45] Date of Patent: Feb. 19, 1991

[54] FIBER OPENING, MIXING, AND FLOW REGULATING APPARATUS AND METHOD

[76] Inventor: James H. Roberson, 10 Ashwood Ave., Greenville, S.C. 29607

[21] Appl. No.: 338,294

[22] Filed: Apr. 14, 1989

[51] Int. Cl.[5] ..... D01G 7/00; D01G 7/04; D01G 7/06

[52] U.S. Cl. ..... 19/97.5; 19/105; 19/145.5

[58] Field of Search ..... 19/81, 97.5, 98, 105, 19/239, 240, 145.7, 156.3, 155

[56] References Cited

U.S. PATENT DOCUMENTS

| | | | |
|---|---|---|---|
| 392,722 | 11/1888 | Dickerson | 19/97.5 |
| 528,389 | 10/1894 | Potter | 19/97.5 |
| 612,566 | 10/1898 | Marsden | 19/105 |
| 3,487,509 | 1/1970 | Bond | 19/105 X |
| 3,738,476 | 6/1973 | Hullett | 19/97.5 |

*Primary Examiner*—Werner H. Schroeder
*Assistant Examiner*—Ismael Izaguirre
*Attorney, Agent, or Firm*—Cort Flint

[57] ABSTRACT

An improved fiber opening, mixing, and flow regulating apparatus and method are disclosed. The apparatus includes a textile fiber feeder (F) which opens, mixes, and regulates the flow of fibers from a ball (B) inside the feeder. A primary opening element is provided by a stationary spiked apron feed (I), and a secondary fiber opening element provided by a movable spiked apron (S). A gap (G) is defined between the opposing pins of the primary and secondary opening elements (I,S) which regulates the flow of fibers delivered by the feeder. By moving secondary opening element (S) in either linear or rotational motions, gap (G) may be modulated and the flow of fibers regulated. A controller (E) may be provided to receive a speed signal (54) representing the operational speed of a textile process downstream of fiber feeder (F) and a fiber quantity signal (16) may also be processed by controller (E) as well as various and other signals. A drive signal (18) controls the movement of secondary opening element (S) and the position may be fed back to the controller (E) by signal (52).

32 Claims, 3 Drawing Sheets

FIBER OPENING, MIXING, AND FLOW REGULATING APPARATUS AND METHOD

BACKGROUND OF THE INVENTION

The present invention relates to the opening, mixing, and regulation of the flow of textile fibers and, in particular, accomplishing these processing steps by the use of novel feeder constructions.

Hopper feeders have long been used in the textile industry. However, the way such devices have been historically configured and operated has imposed serious limitations on their ability to meet "modern" textile needs.

Textile fibers are normally transported and stored in the form of highly compressed bales. In baled form, the individual fibers are matted and entangled very tightly. Before the fibers can be spun into a yarn, or formed into a non-woven fabric, the hard, high density bales must be literally destroyed and the fibers separated to an almost to a fiber-to-fiber state. The reduction of the bulk density of the bales into progressively smaller and smaller tufts of fibers is commonly referred to as "fiber opening". Naturally, The higher the degree of opening, the greater the volume occupied by a given mass or weight of fibers. A single bale will balloon into a tremendous volume as it is refined into smaller and smaller tufts.

The degree and method of fiber opening is extremely important to the textile industry, because it is well known that fibers cannot be properly cleaned or blended or carded until they have been separated into very small tufts. Likewise, the formation of a fibrous batt, for feeding to a subsequent process, requires the use of very small tufts which have a fairly constant size. With tufts in this condition, they can then be re-assembled in a controlled manner to produce a batt which has a fairly uniform bulk density. This enhances the processing regularity and efficiency.

Although small, distinct tufts are highly desired, great care must be taken in how they are generated. Otherwise, the fibers can be curled, bruised and/or broken which reduces the strength of the yarn or product ultimately formed. Likewise, it is possible to "overwork" the fibers such that fibers, well opened at one point, become twisted and reentangled into small knots or ropes. Fibers in this condition are difficult to process, and form neps which are highly detrimental to the quality of the end-product.

Hopper feeders are frequently used as processing machines for textile fibers, and they generally perform four basic functions: (a) They serve as an intermediate storage reserve, or accumulator, for fibers in transit from one process to another, (b) They serve to open the mass of fibers stored within them, (c) They serve to mix the mass of fibers within the storage chamber, and (d) They serve as a flow regulator for the fibers going to a subsequent process. Naturally, the more highly opened the fibers in the hopper feeder become, the better job of mixing them it can do. Likewise, the flow of fibers can be more precisely regulated whenever they are highly opened into very small tufts.

Prior art hopper feeders have the following principal working elements: (a) a reserve chamber which contains a mass or ball of fibers under process, (b) an advancer element which urges the mass or ball of fibers in the reserve chamber forward in the process, (c) a primary opener element which impales globs of stock and tears them from the mass or ball of fibers in the reserve chamber, (d) a secondary opener element which runs in an opposite direction to the primary opener element and strips a major portion of the impaled globs from it and deposits them back into the reserve chamber for repeated processing, and (e) a doffer element which removes the refined globs or tufts that pass through a fixed gap between the two opener elements and deposits such tufts into a receptacle provided to receive the output from the hopper feeder.

In prior art hopper feeders the primary opener element is usually a spiked lift apron (or needled lattice) comprised of numerous parallel slats which contain a large number of protruding needle pins. However, it is also known that one or more rotatably driven, large diameter drums having pins or large teeth disposed about their surface may also be used to perform this opening and transfer function. Conventional secondary opener elements may also take various forms, for example, reciprocating combs (like Item 22, FIG. 1, of U.S. Pat. No. 3,738,476), rotary kick rolls or coarsely pinned revolving cylinders (like Item 28, FIG. 2, of U.S. Pat. No. 3,889,319), or classical stripper aprons (like Item 44, FIG. 2, of U.S. Pat. No. 3,326,609). Various forms of doffer elements have also been used, for example, sweeping air currents (induced by either fans, or rotating blades or brushes disposed about the surface of revolving cylinders), and rotary kick rolls and reciprocating combs similar to those used as secondary opener elements.

The receptacles associated with prior art hopper feeders may take the form of a weighing pan, which weighs up small batches of stock before dumping it for downstream processing. Such art may be seen for example by reference to U.S. Pat. Nos. 3,071,202; 2,727,279; 3,080,617; 3,073,402; 2,885,741; 2,412,506; and RE No. 25,609. Another form of receptacle is a feed chute for forming a batt to be delivered to either a carding machine or to a blending process and such types of art may be seen, for example, by reference to U.S. Pat. Nos. 3,738,476 and 3,889,319. Yet another form of receptacle used is a pneumatic transport channel which carries the tufts from the doffer to subsequent blending or batt forming operations. Still yet another form of receptacle which has been used is a second hopper feeder disposed immediately downstream of a first hopper feeder, so that the two can work as tandem feeders or in series. One serves as a "breaker" opener and the other serves as a "finisher" opener in order to provide the required degree of fiber opening.

For reasons discussed below, the fiber opening potential of a single prior art hopper feeder is so limited that it is fairly common practice to "pre-open" the stock before feeding it into a hopper feeder for subsequent processing. This is particularly true in the case of critical batt forming applications, such as card feeders. This stock opening inefficiency results in the need for additional processing equipment and the additional costs associated with transporting stock from one processing point to another. The present invention proposes to overcome such disadvantages as these, as well as others described later.

Associated with each of the various type receptacles which have been employed has been some form of quantity sensor which measures the need for stock in the receptacle and feeds back a controlling signal which typically operates the primary opener element in order to control the flow of stock into the receptacle. Quantity sensors with a proven capability to provide such form of control have taken many different forms. For example, various forms of switches and transducers operated by "balanced" beams, slide pans or paddle mechanisms, photo electric transducers and switches, ultra-sonic transducers and switches, air pressure actuated transducers and switches, radiation detectors (electro-magnetic and nuclear), stock thickness measuring transducers, weight load cells, and other means have been successfully used to perform the required measuring function.

The "output" signals from some prior art quantity sensors have been On/Off in nature. Such signals have been used to control, or regulate, the flow of fibers into the receptacle by intermittently starting and stopping the primary opening element. Clearly, during those periods when the primary opening element is stopped, it can do no opening of the fibers. Furthermore, while stopped, this element can do no mixing of the fibers. Since opening and mixing are supremely important, such a waste of precious running-time make these type prior art systems unsuitable to meet the objects of the present invention.

The "output" signals from other type prior art quantity sensors varies in proportion to the amount of mass flowing into (or contained in) the receptacle. These type signals are usually employed to control the mass flow rate from the hopper feeder by continually modulating or varying the speed of the primary opener element. This mode of flow control is usually preferred over the start/stop mode because fewer transients are created in the flow of the process. However, as a practical matter, anytime the primary opening element is run at less than its maximum possible speed, there are fewer numbers of possible stabbings and snatchings of globs from the fibrous mass by the pins carried by the primary opening element. Consequently, the opening and mixing potential for these systems is severely diminished. Therefore, the prior art which regulates the flow of fibers by continuously varying the speed of the primary opening element is also unsuited to meet the objects of the present invention.

Accordingly, an object of the present invention is to provide a fiber feeding apparatus which uses the available running-time to its fullest extent in order to maximize the degree of opening and mixing of the fibers being processed.

Another object of the present invention is to provide a feeding apparatus in which the primary and secondary opening elements can run almost continuously, even though the fibers leaving the feeder are being consumed by an intermittent batching operation or the subsequent process is consuming fibers at a variable rate. The continuous running operation of the primary and secondary opening elements thereby increases the degree of opening and mixing potential.

Another object of the present invention is to provide a feeding apparatus in which the primary and secondary opening elements are operated at a high continuous speed, and do not have to speed up and slow down in order to regulate the flow of fibers through the feeder, providing an increased degree of fiber opening and mixing potential.

Another object of the present invention is to provide a fiber feeding apparatus which employs a variable gap between the primary and secondary opening elements which can be automatically adjusted t regulate the flow of fibers from the feeder despite large variations in the bulk density and other property changes in the fibers contained within the feeder reserve.

Still another object of the present invention is to provide a fiber feeding apparatus which utilizes a variable gap between the primary and secondary opening elements which can be automatically opened or closed or modulated in order to regulate the flow of fibers from the feeder so that it can be used in intermittent short-term batching applications.

Still another object of the present invention is to provide a fiber feeding apparatus which is particularly well suited for the processing of small production lots, as well as large production runs, in that a single feeder can be used to perform both the "pre-opening" and "normal run opening" functions without the need to either transfer or reload the fibers.

Yet another object of the present invention is to provide a fiber feeding apparatus which, for a given degree of fiber opening and mixing, can process a higher amount of fiber per unit time thereby reducing the amount of machinery needed, consuming less energy, and minimizing the need for expensive floor space.

SUMMARY OF THE INVENTION

The above objectives are accomplished according to the present invention by providing a textile fiber feeder in which a stationary fiber opening element is disposed and a movable fiber opening element is disposed which moves toward and away from said stationary opening element to define a gap. The gap may be modulated to regulate the flow of fibers through the feeder. The stationary and moving fiber opening elements have a plurality of working elements such as needle pins which are continuously driven to open and mix the fibers. Depending on the setting of the gap, more or less fibers will flow through the feeder with the remaining fibers being continuously opened and mixed. In this manner, both of the fiber opening elements are continuously driven at high speeds for maximum opening and mixing of fibers regardless of the mass of fibers output. The fibers are advanced in the feeder by an advancing apron in a lower portion of the feeder. Various modes of operation of the feeder can be had to obtain an advantageous pre-opening of the fibers followed by normal delivery of the fibers. By using a micro-processor and various sensors, various other modes of operation may also be had for the feeder which increases the effectiveness of the fiber opening and mixing for further processing.

With the present invention, it has been found that the regulation of the rate of flow of fibers through feeders can be more precisely accomplished, the degree of fiber opening within the feeder greatly increased, and the degree of mixing of fibers within the feeder substantially improved, by the use of a movably mounted secondary opening element which may be moved closer to and further away from the surface of a primary opening element in response to a control signal indicative of the status of the flow into a receptacle located downstream from the secondary opening element.

DESCRIPTION OF THE DRAWINGS

The construction designed to carry out the invention will hereinafter be described, together with other features thereof.

The invention will be more readily understood from a reading of the following specification and by reference to the accompanying drawings forming a part thereof, wherein an example of the invention is shown and wherein.

DESCRIPTION OF THE PREFERRED EMBODIMENT

The "primary opening element" will be referred to as a "primary or first opening means", and for the sake of brevity simply as the "impaler". The "secondary opening element" will be referred to as a "secondary or second opening means" and simply as the "stripper".

Figure 1:
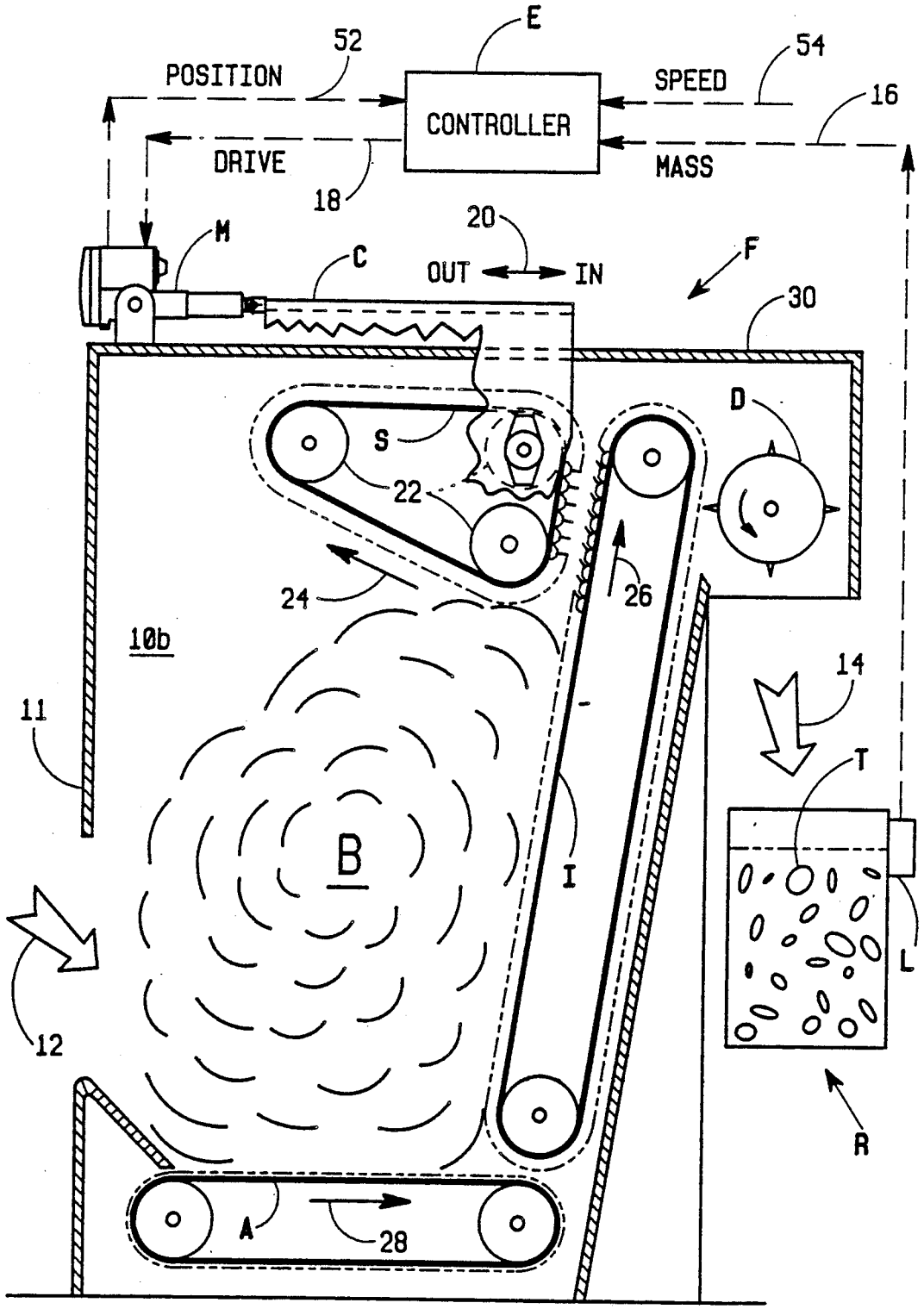
FIG. 1 is a side elevation in section illustrating an apparatus and method for opening, mixing and regulating the flow of fiber in a feeder.

Referring now to FIG. 1 there is shown, generally at F, a fiber feeder schematically constructed according to the present invention. Stock is supplied to feeder F as shown by arrow 12 through an opening provided in the back wall 11 of the feeder F. Refined stock is doffed from impaler I by a doffer D in the form of small tufts T, which exit in the direction of arrow 14, and are received by a receptacle R. Associated with the receptacle R is a quantity sensor L which provides a control signal 16 to a controller E which in turn provides a drive signal 18 to operate an actuator means in the form of a linear actuator M. Of course, doffer D, receptacle R and quantity sensor L may take any of the forms which are known in the prior art, as described above.

Linear actuator M may be any of the several types which are commercially available, for example, model Electrak 205 manufactured by the Warner Electric Brake and Clutch Company of South Beloit, Ill. Such devices are designed so that by simply switching the power input leads, by the controller E, the actuator may be caused to either extend or retract. Linear actuator M is clevis mounted to the top 30 (machine frame) of the feeder F and connected by another clevis arrangement to a movable carriage C. Carriage C supports stripper S such that the latter can be moved "in and out" in the directions indicated by arrow 20.

For illustration purposes, impaler I is shown as a spiked lift apron (or needled lattice) comprised of numerous parallel slats, each of which contains a large number of protruding needle pins, all of which are carried by a flexible band. Advancer apron A may also be constructed using numerous parallel slats, mounted on a flexible band, but such slats are not provided with needle pins, so that they may slippingly drive or urge a mass or ball of fibers B toward impaler I. The mass or ball of fibers B is contained within a reserve chamber defined by sidewalls 10*a* and 10*b*, one face of advancer apron A, and a face of impaler I.

Stripper S may likewise be a spiked apron comprised of a plurality of parallel slats, each loaded with a large number of protruding needle pins, which are carried on a flexible band that is supported on and driven by three pulleys 22. Mounted on movable carriage C is an electric motor (not shown) which is drivingly connected to rotate the pulleys 22 in a conventional manner such that the stripper apron S runs in the direction indicated by arrow 24. A second electric motor (not shown) is mounted on the top 30 of the frame of feeder F and drivingly connected to run impaler apron I in the direction indicated by arrow 26 in a conventional manner. Advancer apron A may be drivingly connected to impaler I such that the former is driven in the direction indicated by arrow 28.

Figure 2C:
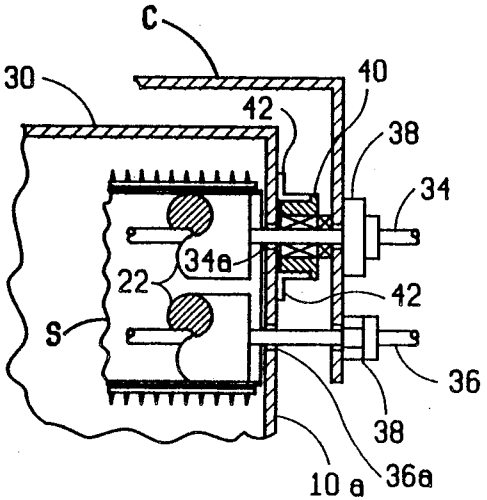
FIG. 2C is a sectional view taken along line IIC—IIC of FIG. 2B.
Figure 2B:
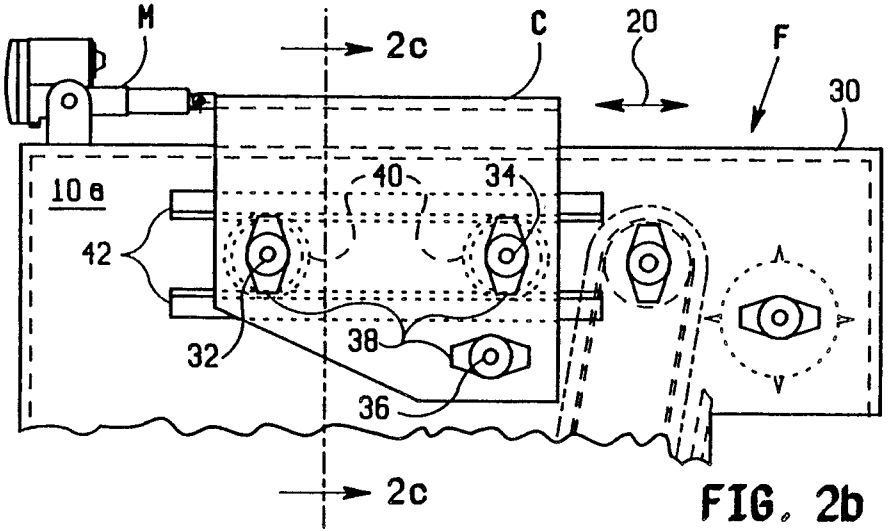
FIG. 2B is a side elevation illustrating a movable fiber opening apron constructed in accordance with the apparatus and method of the present invention.
Figure 2A:
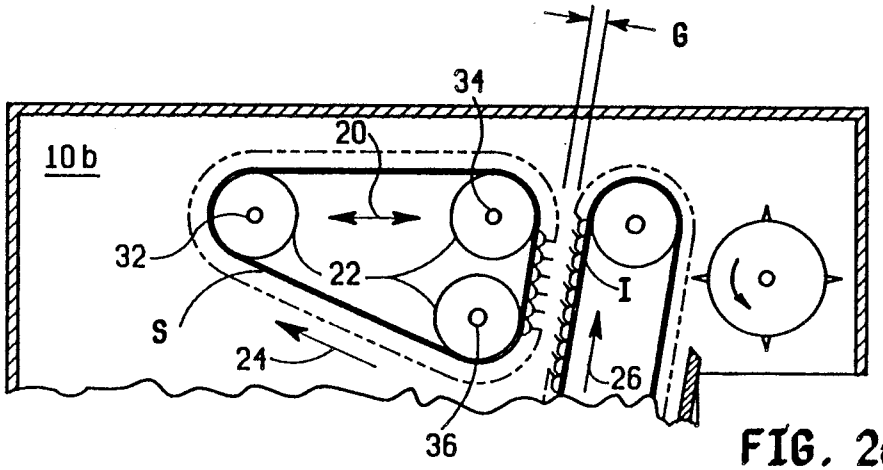
FIG. 2A is a side elevation illustrating an upper section of an apparatus and method for opening, mixing and regulating the flow of fiber in a feeder.

More clearly shown on FIGS. 2*a*, 2*b* and 2*c*, movable carriage C is a horseshoe shaped (or inverted U shaped) framework which straddles the outside of feeder F. The three pulleys 22 which carry stripper apron S, are supported on shafts 32, 34, and 36 which run in six bearings 38, that are fastened three per side, to both outside surfaces of the movable carriage frame C. Shafts 32 and 34 pass through two pair of bearinged flanged wheels 40, and the inner race of each bearing is affixed to the shafts. Each pair of wheels 40 runs in a guide track formed by two L shaped track members 42, and each pair of tracks is fastened to the side plates 10*a* and 10*b*, respectively . With the arrangement just described, stripper apron S may be driven around the three pulleys 22 in the direction indicted by arrow 24, while the traversing carriage C may be concurrently moved in and out with respect to the impaler I in the directions indicated by arrow 20. For this purpose, slots 34*a* and 36*a* (about 4 inches long) in side plates 10*a* and 10*b* allow shafts 34 and 36 to move relative to the side plates as carriage C reciprocates.

In this regards, primary opening means I may be regarded as a stationary fiber opening means, and secondary opening means S may be regarded as a movable fiber opening means. As is more clearly shown in FIG. 2*a*, an opening zone Gap G exists between one face of the stripper apron S and one face of impaler apron I, and gap G may be opened and closed by the linear actuator M moving carriage C back and forth in the direction indicated by arrow 20.

Referring now again to FIG. 1, forward movement of the advancer apron A drives the mass or ball of fibers B into the upward moving pins carried by the impaler I which, working against gravity, stabs and tears globs of fibers from the ball B. These globs subsequently encounter the counter-moving pins carried on stripper S which strips the majority of each glob from the impaler I and deposits the stripped globs back into the reserve chamber for additional processing. The remaining smaller globs, or refined tufts, which escape this stripping action are carried over the top of the impaler I and doffed therefrom by the doffer D. The combined actions of the three aprons A, I, and S causes the ball of fibers B in the reserve chamber to roll and tumble and the tufts contained within it become progressively smaller and fluffier.

Stripper S has a large number of pinned slats disposed to form gauntlet wall, or surface of needle pins, which runs generally parallel to the wall of needle pins carried by the impaler I. This arrangement permits a very intense fiber opening potential. In fact, the opening potential is so great that the fibers can be made to experience a coarse form of carding action as they move between the two counter-moving pinned apron surfaces wherein the impaled tufts are literally shredded. Furthermore, it has been found that if the opening zone gap G is made sufficiently close, or tight, then the amount of stock flowing over the top of the impaler apron I can be reduced, for all intents and purposes to practically nothing as only individual fibers, not typical size tufts, can pass through the gauntlet of pinned walls forming the opening zone gap G. The significance of this observation will become clear momentarily.

It is well known in the textile industry that the longer a given charge of fibers rolls and tumbles in a feeder's reserve chamber, the more loosely the fibrous mass becomes as a result of the repeated pin stabbings and strippings of it. As a consequence, the opening zone gap of prior art devices is always set at a relatively large distance so that a desired minimum amount of fibers can always pass through, regardless of whether the fibers are well opened (highly fluffed) or not. Otherwise, the prior art strippers can more easily engage the highly fluffed fibers and strip off more starving the downstream process. In other words, in prior art systems, the opening zone gap is typically set at a fixed, "worse case" condition to ensure that a sufficient amount of fiber will always flow from the start to the finish of each charge put into the feeder reserve chamber. This is particularly true for "small lot" operations.

Because of the large opening zone gap thus needed by prior art devices, whenever a fresh charge of stock is introduced into the reserve chamber, the rate of production passing over the top of their impalers suddenly becomes very high due to the higher density of the fresh (un-tumbled) stock. This high density stock passes more easily through the "worse case" gap and thus escapes the stripper. Changes in the production rate through hopper feeders can vary as much as 300% to 400% from freshly fed stock to the highly opened state which exists after the ball has rolled and tumbled a typical amount before the feeder is recharged. These high fluctuations in the production through-put are detrimental to the desired regularity and efficiency of the processes. The present invention offers an excellent solution to these type problems.

Figure 3C:
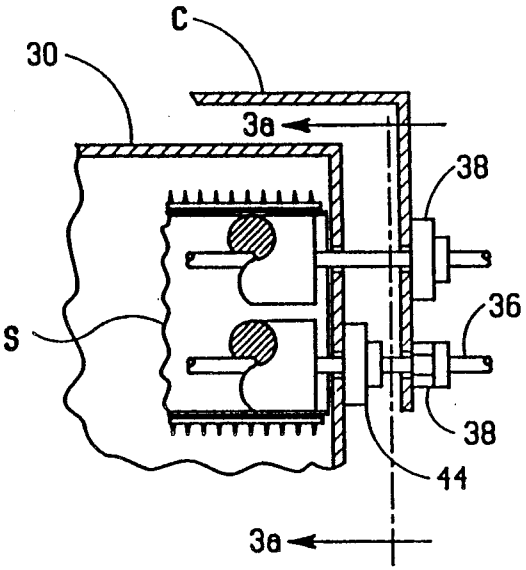
FIG. 3A is an alternate embodiment of a movable fiber opening element constructed in accordance with the apparatus and method of the present invention.
FIG. 3B is an upper view illustrating a carriage for moving the movable fiber opening element in rotational motion.
FIG. 3 is a sectional view taken along line IIIC—IIIC of FIG. 3B.
Figure 3B:
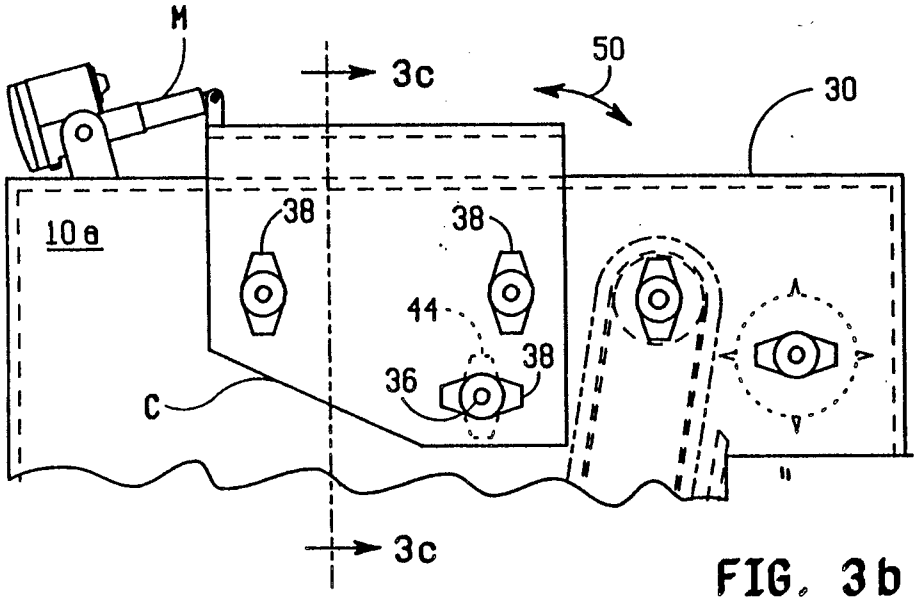
Figure 3A:
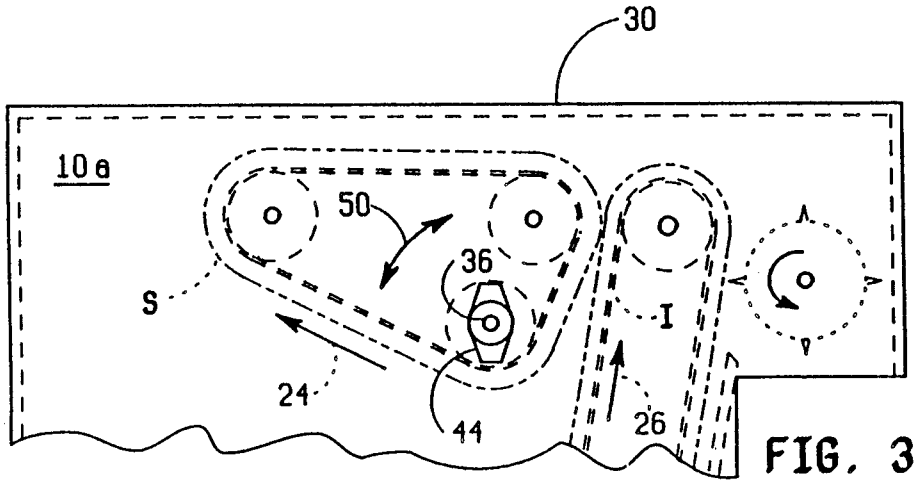

Instead of opening and closing the opening zone gap G by linearly traversing the movable carriage C, it is possible to also modulate gap G by rotating the carriage C about an axis provided by one of the pulley's 22 shafts which may be fixed against translation with respect to the side plates 10*a* and 10*b* of the feeder F. This becomes more clear by referring now to FIGS. 3*a*, 3*b*, and 3*c*. Pulley shaft 36 is translationally fixed with respect to the side plates 10*a* and 10*b* by means of two fixed bearings 44, but the shaft is free to rotate in the bearings while carriage C is supported on both sides by the two bearings 38 which have their inner races fastened to shaft 36. Thus, as linear actuator M extends and retracts the movable carriage rotates about the axis formed by shaft 36 in the direction indicated by arrow 50. Referring to FIG. 3*a*, the opening zone gap is shown nearly fully closed at its upper reach, where the stripper S engages with the impaler I. To open the gap, the linear actuator M would be retracted causing the carriage C to rotate in a counter-clockwise direction. Again, side plates 10*a* and 10*b* may be slotted to permit the carriage movement.

OPERATING MODES

Since it has been found that, for practical short periods, the flow of tufts can be stopped, for all intents and purposes, by merely closing gap G, the present invention offers two different possible modes of flow regulation: (a) quasistart/stop flow, and (b) modulated continuous flow. Here, it is important to note that in either mode, both the impaler I and stripper S continue to run at high speeds (yielding enhanced opening and mixing), while the flow rate is controlled simply by the size of the gap G which may be automatically varied as required by the running conditions.

With the present invention, a micro-processor can be incorporated as part of the control system (controller E), which can receive inputs from any of a number of well known types of mass or quantity sensors L (described above). By its running program, tailored for each different application, controller E can adjust the gap G via linear actuator M. It is also contemplated to be able to use a position sensor (such as a potentiometer, like the one included with the commercial actuator defined above) so that controller E will "know", position signal 52, at all times what the gap distance G actually is relative to what the program computes or determines that it should be for the instantaneous operating conditions. The term "quantity" as used in reference to sensors or signals means mass, weight, height, thickness, density, etc., and/or mass or flow per unit of time.

Quasi-start/stop flow regulation is the preferred method for weight pan batch feeding applications such as when a weighing pan is employed as the receptacle R. To fill such a weighing pan, gap G would first be opened wide in order to pass a high flow. Whenever the weight transducer (quantity sensor L) signals that the desired wight is being approached, the gap G could be made progressively tighter (via the running program) permitting "trickle feeding". After the desired weight has been achieved in the weigh pan, gap G would be closed to its tightest position which essentially stops the flow. Since the delay time, between filling the pan and dumping it is normally relatively short, the "fly" or highly opened individual fibers which do escape gap G can be accommodated in the trap door cavity beneath the doffer D. In the art, it is customary to provide such a trap door and cavity between the doffer and the weighing pan, in order to capture the globs of stock in flight after the "shut-off" signal has been sent. However, to ensure that this cavity is not overfilled, the micro-processor can be programmed to stop impaler I if the pan is not dumped within a pre-determined period after filling.

Alternatively, it may be desired to use the receptacle R as a chute feeder, for example, for forming a batt for feeding to a carding machine. In this case, receptacle R can also be kept supplied with stock using the quasi-start/stop mode of flow control. Here, quantity sensor L could take the form of a photocell level controller, which would start/stop the flow by opening and closing the gap G. Although this is not the optimum system configuration, it is nevertheless far superior to the prior art which start/stops the flow by start/stopping the operation of the impaler apron. With the present invention, this apron continues to run even when the flow is stopped to provide improved opening and mixing of the fibers. However, in this example application it is desirable to stop impaler I whenever the carding machine itself is stopped for sustained periods.

The preferred method for supplying tufts to the receptacle R of a chute feeding application is via the modulated continuous flow regulation mode of control. In this case, quantity sensor L could take the form of two closely spaced photocell level sensors positioned near the top of the stock column in the chute, and the running program in controller E designed to "seek" the gap G which holds the stock level between the two photocell detectors. In the overall program, the micro-processor first "reads" a speed signal 54 (from a transducer not shown) indicative of the speed of an output roll of the carding machine to determine what the basic flow rate is for the system. This provides the master (or starting point) gap setting information. Next, the micro-processor "reads" the two photocell level sensors, which provides information that is used to trim, or fine tune, the master gap setting. Then, the position signal 52 is "read" so that the micro-processor "knows" what the instantaneous gap G actually is. Controller E, via drive signal 18, then causes actuator M to correct for any discrepancy between the program computed gap G and the actual instantaneous measured gap.

Those skilled in the art will immediately recognize how a micro-processor can be programmed to use the aforesaid "readings" or inputs so that it can perform the above described functions. Thus, as the bulk density or other properties of the fibrous mass B change, the micro-processor continuously regulates the gap setting G to compensate for these conditions so that the mass flow rate into the receptacle remains essentially constant. And, as the production rate requirements are changed (speed of the card is changed), the micro-processor can quickly make adjustments to the basic gap setting to immediately compensate for this variable. This greatly minimizes the tendency to "over-shoot" or "hunt"; which happens when just a level sensor (prior art design) is used as the sole means for monitoring and controlling the flow through the feeder.

According to a method of the present invention a master signal, speed signal 54, from the downstream process may be used in combination with a trim signal, quantity signal 16, to actively and positively set the operating value for the flow regulating mechanism in feeders. The prior art has historically approached this matter in a purely passive sense. That is, they let the stock in the receptacle either pile-up (overfill) or starve-out whenever production rate changes were made until the level or quantity sensor detects this massive transient condition, and thereafter slowly act by "hunting" and "over-shooting" to stabilize the flow. Naturally, this prior art disadvantage leads to highly undesirable weight variations to the downstream process and, ultimately, the quality of the end-product.

Another method contemplated by the present invention involves monitoring the instantaneous gap position at all times (via position signal 52), because this is an excellent indicator of the instantaneous properties of the fibrous mass B. With this information, whenever the micro-processor detects a sudden speed change in the downstream process for example, the carding machine is put into "slow-speed" (in order to doff a can of sliver) the instantaneous gap position would be stored in memory as, "home". Then, the micro-processor could quickly change the gap setting to that which corresponds with the new speed. As soon as the card is returned to its former speed, the micro-processor would re-set the gap again to the "home" position.

This procedure eliminates setting the gap to just an arbitrary speed related gap, which may not be the optimum, which would force the quantity sensor L to have to make a major trim, due to the error. In effect, the micro-processor is capable of re-defining its various running set points based on current fiber properties, rather than arbitrary values.

Another method contemplated for the present invention is to add a "memory" section to controller E and to program the micro-processor such that it mathematically constructs running "histograms"; which relate gap settings to process speeds, and relates these to time elapsed since last running at a different speed. Thus, the micro-processor constructs a map and continually updates it which defines historically optimum gap settings as a function of process speeds and time elapsed since last speed change. Anytime the micro-processor detects any process speed change it "knows" the historically optimum gap setting to employ. This sophistication can be beneficial for two reasons: (a) The "home" gap (described in the previous paragraph) becomes less valid the longer the process runs at a new speed because the fiber properties can change, and (b) the process might be subsequently changed to a different new speed from that for which "home" was originally defined.

Yet another feature contemplated for the present invention stems from the fact that the same feeder can be dually used, first, in a "pre-opening" mode, and, secondly in a "normal run" mode without the need to either remove the stock or transport it from one processing point to another. This feature is particularly advantageous for the processing of small lots such as one charge to the feeder's reserve chamber. It also valuable for the beginning of longer production runs. This feature comes about because the flow can be essentially stopped while the impaler I and stripper S concurrently continue running to open and mix the fibers. To utilize this feature, the micro-processor is first put into the "pre-open" mode which causes it to close gap G very tightly. Then, the feeder's reserve chamber is filled with a charge of fibers which is thereafter rolled and tumbled for a short period until the fibers are loosened to such a state that they are suitable for use by the downstream process. At this point, the microprocessor switches to the "normal run" mode and it slowly opens gap G to finish filling the receptacle R with well opened fiber so that the downstream process can be started. From then on, the running continues in the usual fashion (as described above) until all the fibers have been consumed. Here, it is significant to note that during the "pre-opening" period, the relatively small amount of fiber which does pass through gap G and falls into the receptacle R is highly opened and, thus, already suitable for the downstream process.

This concurrent dual-use, of the same feeder F with just one charging, is not practical with prior art systems because of the wide "worse-case" gap setting required between their impaler and stripper elements. Consequently, when they are first charged with fresh stock, much of it escapes the stripping action and the receptacle is very quickly filled. This requires that the impaler element be stopped until some of this stock has been removed. To overcome this drawback, the prior art usually performs the "pre-opening" at a first point and the "normal run opening" at yet a second point. This is often accomplished by the use of two tandem feeders operating in series. A "breaker" feeder feeds a "finisher" feeder. With the present invention it is possible to do with just one hopper feeder, what the prior art usually needs two to accomplish.

It will be noted that the opening zone gap G can be controlled to yield substantially the same results by fixing the stripper S, and moving the impaler I relative to it. Although a driven apron has been disclosed as the preferred form of advancer element A, those skilled in the art know that an inclined slide plate whereby gravity slides the mass of fiber B downward and forward into the pins of the impaler I has been successfully used to perform this same function. Finally, it will be noted that various mechanisms are available as equivalent substitutes for the linear actuator M schematically disclosed herein. For example, fluid operated pistons (fitted with the appropriate valving, piping and logic controls), "lead screw" positioners, "rack and pinion" positioners, cam operated positioners, et cetera.

While a preferred embodiment of the invention has been described using specific terms, such description is for illustrative purposes only, and it is to be understood that changes and variations may be made without departing from the spirit or scope of the following claims.

What is claimed is:

1. A textile feeder apparatus for processing textile fibers of the type which opens and mixes textile fibers in a reserve chamber and regulates the flow of fibers from said feeder, said apparatus comprising:

a reserve chamber means for containing fibers under process;

a first fiber opening means having working elements for impaling and tearing loose some of the fibers contained in said reserve chamber and carrying said impaled fibers forward in the process thereby partially opening said impaled fibers;

a second fiber opening means having working elements for stripping a portion of said impaled fibers from the working elements of said first fiber opening means and returning said stripped fibers to said reserve chamber means for additional processing thereby increasing the degree of opening of said stripped fibers;

a working gap defined between said first and second fiber opening means;

a sensor means for sensing a function of a quantity of fibers flowing from said feeder and generating a fiber quantity signal;

control means responsive to said fiber quantity signal for producing a driving signal; and an actuation means responsive to said driving signal for moving at least one of said first and second fiber opening means relative to the other thereby modulating said gap and regulating the amount of fibers flowing out of said feeder by governing the proportion of fibers stripped from said first opening means and returned to said reserve chamber for additional opening and mixing by said second fiber opening means.

2. The apparatus of claim 1 wherein said control means produces said driving signal in a programmed manner.

3. The apparatus of claim 2 including an operational signal representing the operational speed of a textile process downstream of said feeder, and said control means receiving said operational signal for processing with said fiber quantity signal to modulate said gap.

4. The apparatus of claim 3 including mans for generating a gap position signal representing the instantaneous setting of said gap; and said control means processing said gap position signal and said fiber quantity signal to modulate said gap.

5. The apparatus of claim 2 including means for generating a gap position signal representing the instantaneous setting of said gap; and said control means processing said gap position signal and said fiber quantity signal to modulate said gap.

6. The apparatus of claim 2 wherein said control means controls said actuation means to adjust said gap to a generally closed condition whereupon fibers are retained in said feeder and are continuously opened and mixed without any significant flow of fibers past said gap and exiting said feeder in a pre-opening mode of operation; and said control means control said actuation means to modulate said gap and regulate said flow of fiber in a normal run mode of operation to provide said desired flow of fibers.

7. The apparatus of claim 6 wherein said first plurality of needle pins and said second plurality of needle pins terminate generally in planes which are generally parallel to each other.

8. The apparatus of claim 6 wherein said first plurality of needle pins and said second plurality of needle pins terminate in planes which intersect each other.

9. The apparatus of claim 1 wherein said first fiber opening means includes a primary spiked lift apron and said working elements comprise a first plurality of protruding needle pins.

10. The apparatus of claim 9 wherein said second fiber opening element includes a secondary spiked apron and said working elements comprise a second plurality of protruding needle pins.

11. The apparatus of claim 10 wherein said primary spiked lift apron is stationary with respect to a frame of said feeder and said actuation means is operatively connected to said secondary spiked apron for moving said secondary spiked apron relative to said primary spiked lift apron to modulate said gap and regulate said flow of fibers.

12. The apparatus of claim 11 wherein said secondary spiked apron is carried by a carriage which is operatively connected to said actuation means.

13. The apparatus of claim 12 wherein said actuation means moves said carriage and hence said secondary spiked apron in linear motion to modulate said gap.

14. The apparatus of claim 13 wherein said actuation means moves said carriage and hence said secondary spiked apron in rotational motion to modulate said gap.

15. The apparatus of claim 1 wherein said first fiber opening means is stationary with respect to a frame of said feeder and includes a spiked lift apron having working elements comprised of plurality of protruding needle pins; and includes carriage means operatively connected to said actuation means for carrying and moving said second fiber opening means as a movable opening means.

16. The apparatus of claim 15 wherein said carriage means moves said movable opening means in linear motion.

17. The apparatus of claim 15 wherein said carriage means moves said movable opening means in rotational motion.

18. The apparatus as in any one of claims 1 through wherein:

said first fiber opening means includes a spiked lift apron having working elements comprised of a plurality of protruding needle pins; and said second fiber opening means includes a spiked apron having working elements comprised of a plurality of protruding needle pins and has a face disposed to travel generally parallel to but in opposite direction of a face of said first fiber opening means thereby creating gauntlet walls of protruding needle pins which enhances the flow regulating characteristics of said gap when it is modulated open and enhances the flow preventing characteristics of said gap when it is closed.

19. The apparatus of claim 1 including control means for controlling said actuation means to modulate said gap and regulate said fiber flow while the fibers remaining in said feeder are continuously opened and mixed by said first and second fiber opening means driven at high and continuous speeds.

20. The apparatus of claim 1 including advancing means for advancing fibers within said reserve chamber means as other fibers are opened by the stationary opening means and the movable opening means to mix said fibers in said reserve chamber means.

21. A method of opening, mixing, and regulating the flow of fibers with a textile feeder and the like comprising:

employing a reserve chamber for holding a portion of the fibers under process;

impaling a portion of fibers contained in said reserve chamber and advancing said impaled fibers forward in the process using a first opening means;

stripping a portion of said impaled fibers from said first opening means and returning said stripped fibers to said reserve chamber for additional opening and mixing using a second opening means;

regulating the flow of fibers delivered from said feeder as a desired quantity by modulating a gap defined between said first and second opening means to govern the proportion of fibers stripped from said impaled fibers and thus prevented from flowing through said gap and being delivered from said feeder; and amplifying a sensor signal to a driving signal to enable modulation of said gap through a significant distance to accommodate the processing of fibers having wide changes in their properties and processing characteristics.

22. The method of claim 21 including moving said second opening means in linear motion with respect to said first opening means which is stationary to modulate said gap.

23. The method of claim 21 including moving said second opening means in rotational motion with respect to said first opening means which is stationary to modulate said gap.

24. The method of claim 21 including opening and mixing fibers contained in said reserve chamber while modulating said gap by advancing fibers in said reserve chamber while said first and second opening means are opening and mixing fibers.

25. The method of claim 21 including continuously driving said first and second opening means as said gap is modulated and the flow of fibers is regulated.

26. The method of claim 21 including driving said first and second fiber opening means at a continuous and high speed while modulating said gap and regulating said fiber flow so that fibers remaining in said reserve chamber are continuously opened and mixed while waiting to be fed.

27. The method of claim 21 including sensing the quantity of fiber fed by said feeder, generating a fiber quantity signal, and modulating said gap to feed a desired quantity in response to said quantity signal.

28. The method of claim 21 including sensing the operational speed of a textile processing machine to which fibers from said feeder are fed and generating an operational signal;

sensing a function of the quantity of fibers delivered from said feeder and generating a fiber quantity signal; and processing said operational signal and fiber quantity signal to facilitate the modulation of said gap.

29. The method of claim 28 including sensing the instantaneous condition of aid gap and generating a gap condition signal; and processing said operational signal, said fiber quantity signal, and said gap condition signal to facilitate the modulation of said gap.

30. The method of claim 21 including sensing the instantaneous condition of said gap and generating a gap condition signal;

sensing a function of the quantity of fibers delivered from said feeder and generating a fiber quantity signal; and processing said gap condition signal and fiber quantity signal to facilitate the modulation of said gap.

31. The method of claim 21 including:

closing the gap in a pre-opening mode of operation wherein said gap is moved to a generally closed setting and said impaled fibers are prevented from passing through said gap and remain in said feeder where they are continuously opened and mixed by said first and second opening means;

opening said gap in a normal mode of operation to a desired setting for regulating the flow of fibers through said gap to deliver a desired quantity of fibers.

32. The method of claim 31 including maintaining said feeder in a pre-opening mode until said fibers are loosened to a desired state so that they are suitable for use in said textile process downstream.

* * * * *